US008427339B2

(12) United States Patent
Adachi et al.

(10) Patent No.: US 8,427,339 B2
(45) Date of Patent: Apr. 23, 2013

(54) INFORMATION PROVISION SYSTEM AND IN-VEHICLE APPARATUS

(75) Inventors: Tetsuro Adachi, Okazaki (JP); Akira Tsukamoto, Kariya (JP); Yoshitaka Ozaki, Okazaki (JP)

(73) Assignee: DENSO CORPORATION, Kariya (JP)

( * ) Notice: Subject to any disclaimer, the term of this patent is extended or adjusted under 35 U.S.C. 154(b) by 562 days.

(21) Appl. No.: 12/654,003

(22) Filed: Dec. 8, 2009

(65) Prior Publication Data

US 2010/0148988 A1 Jun. 17, 2010

(30) Foreign Application Priority Data

Dec. 17, 2008 (JP) ..... 2008-320976

(51) Int. Cl.
*G08G 1/00* (2006.01)

(52) U.S. Cl.
USPC ..... 340/901; 340/905; 340/425.5

(58) Field of Classification Search ..... 340/901
See application file for complete search history.

(56) References Cited

U.S. PATENT DOCUMENTS

| | | | | |
|---|---|---|---|---|
| 6,298,301 | B1 * | 10/2001 | Kim | 701/517 |
| 6,456,930 | B1 * | 9/2002 | Naito et al. | 701/410 |
| 6,937,162 | B2 * | 8/2005 | Tokitsu et al. | 340/928 |
| 2008/0150707 | A1 | 6/2008 | Shamoto | |

FOREIGN PATENT DOCUMENTS

| | | |
|---|---|---|
| JP | A-2004-053461 | 2/2004 |
| JP | A-2007-101447 | 4/2007 |

OTHER PUBLICATIONS

Office Action mailed Dec. 21, 2010 in corresponding JP patent application No. 2008-320976 (English translation enclosed).

* cited by examiner

*Primary Examiner* — Kerri McNally
(74) *Attorney, Agent, or Firm* — Posz Law Group, PLC

(57) ABSTRACT

An information provision system, which includes (i) a navigation apparatus in a vehicle and (ii) an information center, provides an occupant of the vehicle with information. The navigation apparatus and information center communicate via a wireless communication link. The navigation apparatus wirelessly acquires reception position information, which indicates several reception positions, from the information center. When determining that the vehicle reaches one of the reception positions, the navigation apparatus wirelessly acquires, in association with the reached reception position, display-related information containing (i) display position information indicating a display position and (ii) at-display-position window information indicating contents of a display window displayed at the display position. When determining that the vehicle reaches the display position, the navigation apparatus displays the contents of the corresponding display window indicated by the acquired at-display-position window information.

8 Claims, 8 Drawing Sheets

INFORMATION PROVISION SYSTEM AND IN-VEHICLE APPARATUS

CROSS REFERENCE TO RELATED APPLICATION

The present application is based on and incorporates herein by reference Japanese Patent Application No. 2008-320976 filed on Dec. 17, 2008.

FIELD OF THE INVENTION

The present invention relates to an information provision system and an in-vehicle apparatus for providing an occupant of a vehicle with information.

BACKGROUND OF THE INVENTION

[Patent document 1] JP-2008-158887 A (corresponding to US-2008/0150707)

Japan's VICS (Vehicle Information and Communication System) has a function to provide an in-vehicle apparatus mounted in a vehicle with traffic information ahead of or around the vehicle via radio wave beacons or optical beacons alongside of roads, when the vehicle approaches the beacons.

In addition, an information provision system is known which provides an occupant of a vehicle with a variety of information by executing wireless communication between an in-vehicle apparatus and an over-road device installed near travel routes of the vehicle (see Patent document 1).

In addition, a navigation apparatus is known which executes a route guidance to a destination by detecting a present position of the vehicle using a GPS receiver etc. and displaying a travel route from the present position to the destination as well as a road map in a display device. In such a navigation apparatus, when approaching a turning point or intersection during executing the route guidance to the destination, an enlarged view of the turning point or intersection is displayed to explicitly indicate the heading direction at the turning point or intersection. Thereby, it becomes easy for the driver or user to run at the turning point or intersection as guided by the navigation apparatus.

It is noted that, in the above VICS system, the information provision position at which the vehicle is provided with the information is limited to the installation positions of the radio wave beacons and optical beacons. That is, to change or increase the positions for the information provision, it is necessary to change or increase the installation positions of the radio wave beacons and optical beacons. Accordingly, there is a technical problem that the change or increase in the information provision positions are not so easy.

In addition, in the information provision system in above Patent document 1, the information provision positions providing the vehicle with the information is limited to the installation positions of the over-road devices. However, since the over-road devices are needed to be installed in roads, the installation positions are carefully considered in order to make the installation number minimum. Accordingly, there is a technical problem that the change or increase in the information provision positions are not so easy.

In addition, in the above navigation apparatus, the image data displayed on the display device is stored in the storage media, such as a HDD and DVD-ROM. Thus, the navigation apparatus executes route guidance by reading the required image data from the storage medium. When the image data stored in the storage medium is not updated successively, there is a possibility that the enlarged view of the turning point or intersection illustrated by the image data comes not to reflect the present state as time elapses.

SUMMARY OF THE INVENTION

The present invention is made in view of the above technical problem. It is an object of the present invention to provide a technology to facilitate (i) change or increase of information provision positions and (ii) acquisition of newest provision information.

To address the above object of the present invention, according to a first example of the present invention, an information provision system is provided to include an in-vehicle apparatus in a vehicle and an information center for providing an occupant of the vehicle with information. Herein, the in-vehicle apparatus and the information center are communicable with each other using a wireless communication. The information center comprises the following: a communication position storage section; a notification storage section; a communication position distribution section; a reached communication position acquisition section; and a notification distribution section. The communication position storage section is configured to store a communication position information item to indicate several communication positions at which the in-vehicle apparatus is allowed to execute the wireless communication with the information center. The notification storage section is configured to store, with respect to each of the communication positions, (i) a communication position information item for indicating the each of the communication positions, (ii) a notification position information item for indicating a notification position, and (iii) a notification information item which is notified to the occupant of the vehicle at the notification position, in association with each other. The communication position distribution section is configured to distribute to the in-vehicle apparatus the communication position information item, which indicates the several communication positions and is stored in the communication position storage section, using the wireless communication. The reached communication position acquisition section is configured to acquire a reached communication position information item indicating a reached communication position, which is one of the several communication positions and reached by the vehicle, from the in-vehicle apparatus using the wireless communication. The notification distribution section is configured to distribute, with respect to the acquired reached communication position information item, a notification position information item and a notification information item from within the notification position information items and the notification information items stored in the notification storage section, to the in-vehicle apparatus using the wireless communication. In contrast, the in-vehicle apparatus comprises the following: a vehicle position acquisition section; a communication position acquisition section; a communication position determination section; a reached communication position transmission section; a notification acquisition section; a notification position determination section; and a notification section. The vehicle position acquisition section is configured to acquire a vehicle position information item indicating a present position of the vehicle. The communication position acquisition section is configured to acquire the communication position information item, which is distributed by the communication position distribution section of the information center using the wireless communication. The communication position determination section is configured to determine whether the vehicle reaches a communication position, based on (i) the communication positions indicated by the acquired communication position information item, and (ii) a present position of the vehicle indicated by the acquired vehicle position information item. The reached communication position transmission section is configured to transmit the reached communication position information item indicating the reached communication position being the one of the several communication positions, when the communication position determination section determines that the vehicle reaches the one of the several communication positions, to the information center using the wireless communication. The notification acquisition section is configured to acquire the notification position information item and the notification information item, both of which are distributed by the notification distribution section of the information center using the wireless communication. The notification position determination section is configured to determine whether the vehicle reaches the notification position, based on (i) the notification position indicated by the acquired notification position information item (ii) the present position of the vehicle indicated by the acquired vehicle position information item. The notification section configured to notify the occupant of the vehicle of contents indicated by the acquired notification information item when the notification position determination section determines that the vehicle reaches the notification position.

As a second example of the present invention, an in-vehicle apparatus is provided as being the in-vehicle apparatus included in the above information provision system of the first example of the present invention.

As a third example of the present invention, a method is provided for supplying an occupant of a vehicle with information in a system including an information center and an in-vehicle apparatus in the vehicle. The information center and the in-vehicle apparatus are communicable with each other using a wireless communication. The information center stores (a) information on several communication positions at which the in-vehicle apparatus is allowed to execute the wireless communication with the information center, and (b) notification-related information, which associates, with respect to each of the communication positions, (i) a notification position, and (ii) notification contents notified at the notification position. The in-vehicle apparatus acquires a present position of the vehicle. The method is provided by comprising: (a) transmitting from the information center to the in-vehicle apparatus the stored information on several communication positions; (b) determining in the in-vehicle apparatus that the vehicle reaches a communication position being one of the several communication positions, based on an acquired present position; (c) transmitting from the in-vehicle apparatus to the information center, information indicating the reached communication position; (d) transmitting from the information center to the in-vehicle apparatus, notification-related information, which is selected from the stored notification-related information, the selected notification-related information containing a notification position and notification contents in association with the reached communication position; and (e) determining by the in-vehicle apparatus that the vehicle reaches the notification position indicated by the received notification-related information, based on an acquired vehicle position, thereby notifying the occupant of the vehicle of the notification contents indicated by the received notification-related information at the reached notification position.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

First Embodiment

Hereinafter, description will be given to a first embodiment of the present invention with reference to the drawings.

Figure 1:
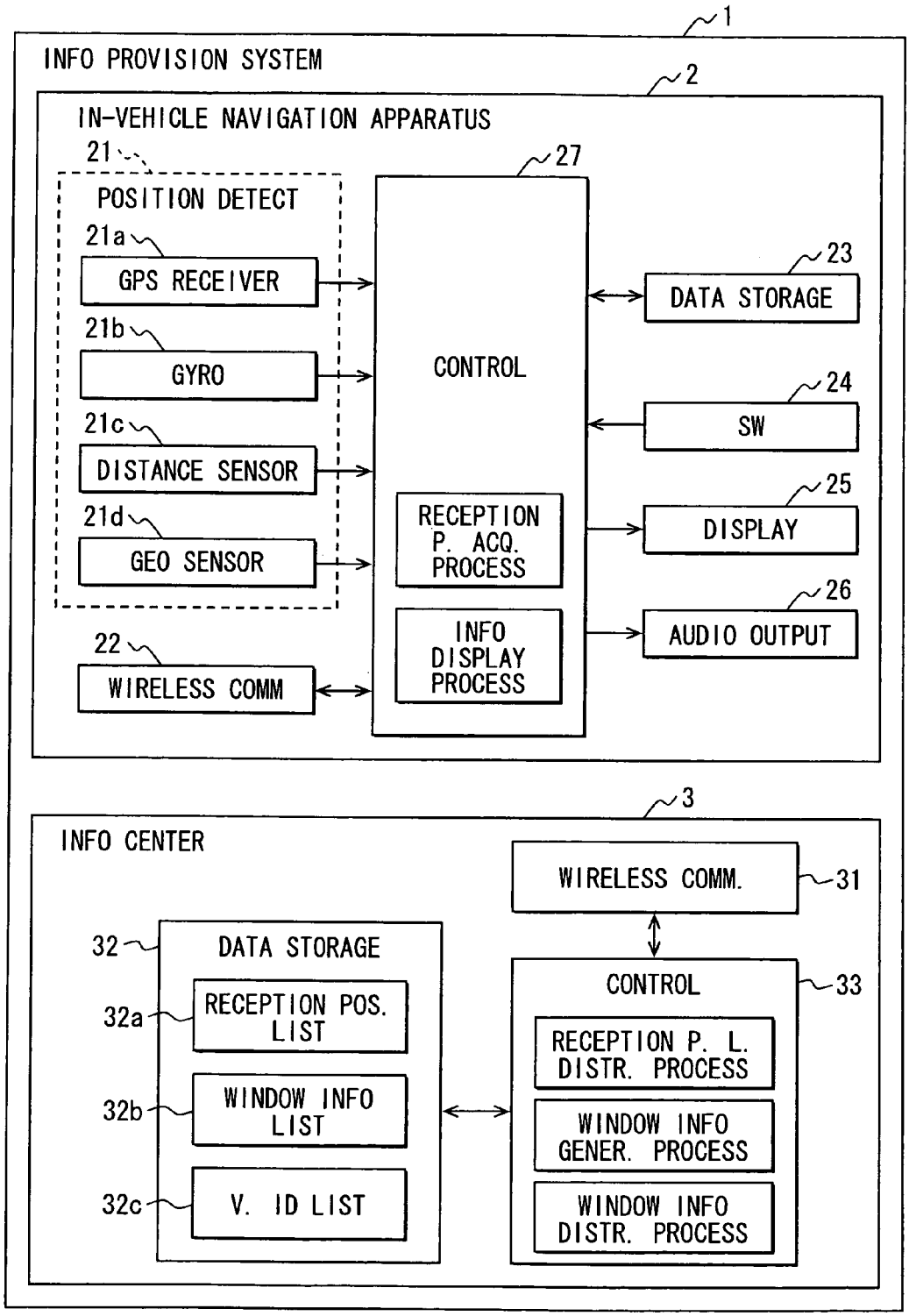
FIG. 1 is a block diagram illustrating a configuration of an information provision system according to an embodiment of the present invention.

FIG. 1 is a block diagram illustrating a configuration of an information provision system 1 of embodiments according to the present invention.

The information provision system 1 includes a navigation apparatus 2 in a subject vehicle for performing a route guidance from a present position to a destination, and an information center 3. The information provision system 1 is for providing an occupant of the vehicle with information. Furthermore, it is noted that although only one navigation apparatus 2 is illustrated in FIG. 1 in the information provision system 1, the information center 3 of the information provision system 1 can communicate with several navigation apparatuses 2 for distributing information.

The navigation apparatus 2 includes the following: a position detection section 21 for detecting a present position of the vehicle (i.e., detecting a position where the vehicle is presently located); a wireless communication section 22 for executing wireless communication via a wireless communication link with a wireless communication section 31 (aftermentioned) of the information center 3; a data storage section 23 for storing map data and various kinds of information; an operation switch group 24 for inputting various instructions from a user; a display section 25 for performing various displays such as a map display window or TV window; an audio output section 26 for outputting various kinds of guidance sounds; and a control circuit 27 (or controller 27). The control circuit 27 functioning as a control means or section controls executions of the various processes based on inputs from the above-mentioned position detection section 21, the wireless communication section 22, and the operation switch group 24 while controlling the wireless communication section 22, the data storage section 23, the display section 25, and the audio output section 26.

The position detection section 21 includes the following sensors or the like: a GPS receiver 21*a*, which receives via a GPS antenna (not shown) electric waves from satellites for GPS (Global Positioning System) and is used for detecting a position, orientation, or speed of the vehicle; a gyroscope 21*b* which detects rotational movement exerted over the vehicle; a distance sensor 21*c* which detects a travel distance of the vehicle from an acceleration in a front-and-back direction of the vehicle; and a geomagnetic sensor 21*d* which detects a heading direction of the vehicle from geomagnetism. The individual sensors or the like 21*a* to 21*d* have different types of detection errors from each other; therefore, they are used to complement each other. In addition, only a part of the sensors or the like may be used depending on the required detection accuracy or each sensor's detection accuracy. Further, another sensor or the like such as a revolution sensor of steering and a wheel sensor of a following wheel may be used.

In addition, the data storage section 23 stores various data and a navigation program. The data include map data, mark data, and map matching data for improving a position location accuracy. The navigation program is executed by the control circuit 27 for operating the navigation apparatus 2. The data storage section 23 includes as a storage medium a magnetic storage device such as a hard disk in view of the required data volume.

The control circuit 27 mainly includes a known microcomputer having a CPU, ROM, RAM, I/O, and a bus line connecting the foregoing components or the like. The control circuit 27 has a function to calculate a present position of the vehicle based on detection signals from the position detection section 21 using the program stored in the data storage section 23 and display in the display section 25 a map around the calculated present position, the map which is read from the data storage section 23. In addition, the control circuit 27 has a function to display, in the display section 25, road traffic information such as road congestion information, road traffic restriction information, which is received from the information center 3.

In the above configuration of the navigation apparatus 2 of the present embodiment, the control circuit 27 executes (i) a reception position acquisition process to acquire a reception position list 32*a*, and (ii) an information display process to display at-display-position window information, separately from each other, as shown in FIG. 1.

Next, the information center 3 includes: a wireless communication section 31 to execute a wireless communication via a communication link with the wireless communication section 22 of the navigation apparatus 2; a data storage section 32 to store various kinds of information; and a control circuit 33 (or controller 33). The control circuit 33 executes various processes according to inputs from the wireless communication section 31, and controls the wireless communication section 31 and the data storage section 32.

The data storage section 32 stores a reception position list 32*a*, a window information list 32*b*, and a vehicle type list 32*c* (also referred to as a vehicle ID list 32*c*).

The reception position list 32*a* stores reception position information (i.e., a reception position information item) indicating several reception positions, at each of which the navigation apparatus 2 is allowed to receive display-information window information from the information center 3. Further, a "reception position" may be referred to as a "communication position."

The window information list 32*b* stores, with respect of (or in association with) each of the several reception positions, (i) reception position information (i.e., a reception position information item) indicating the each of the several reception positions, (ii) display-related information which contains (a) a display position information item, and (b) an at-display-position window information item; the reception position information and the display-related information are associated with each other.

Furthermore, the at-display-position window information includes (i) image data of an enlarged view of a turning point or intersection (referred to as "enlarged view image data"); (ii) image data of a drawing illustrating a traffic congestion state of a road (referred to as "traffic congestion image data"); and (iii) an additional image data. The additional image data includes at least one of (i) image data of a drawing illustrating a time (i.e., a travel time) required for the vehicle from starting off a predetermined departure point to arriving at a predetermined arrival point; (ii) image data of a drawing illustrating a position of a parking lot around the corresponding reception position (referred to as "parking lot image data); and another image data. In addition, the display position information item indicates a position (referred to as "display position), at which the at-display-position window information is displayed in the display section 25 of the subject vehicle.

It is noted that the information provided to an occupant of the vehicle may not need to be limited to visual information such as display information or display window information but may be further include other types of information such as audio information or tactile information. Thus, "display position information" may be generically referred to as "notification position information" whereas "at-display-position window information" may be generically referred to as "notification position information" or "at-notification-position information." Further, a "display position information" and "at-display-position window information" is collectively referred to as "display-related information," which may be further generically referred to as "notification-related information."

Figure 7:
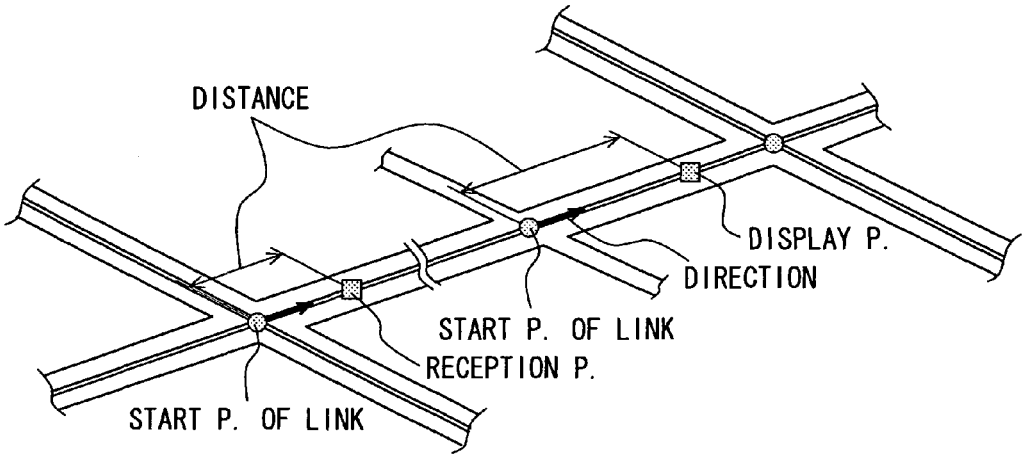
FIG. 7 is a diagram explaining a configuration of reception position information and display position information.

Furthermore, the reception position information item and display position information item are configured by using link information in the map data of the navigation apparatus 2. In detail, each of the reception position information item and display position information item is represented using a link ID for identifying a link, information on distance from a link start point (or a link end point), a direction, and etc., as illustrated in FIG. 7.

The vehicle type or vehicle ID list 32*c* stores, with respect to each of the vehicle identifications (IDs), (i) a vehicle identification information item and (ii) a vehicle type (passenger car, track, bus, etc.) assigned with the vehicle identification information item, in association with each other.

The control circuit 33 includes a known microcomputer having a CPU, ROM, RAM, I/O, and a bus line connecting the foregoing components or the like.

The control circuit 33 of the information center 3 according to the present embodiment executes (i) a reception position list distribution process which distributes the reception position list 32*a*; (ii) a window information generation process which generates at-display-position window information; and (iii) a window information distribution process which distributes the at-display-position window information, separately from each other, as shown in FIG. 1.

Figure 2:
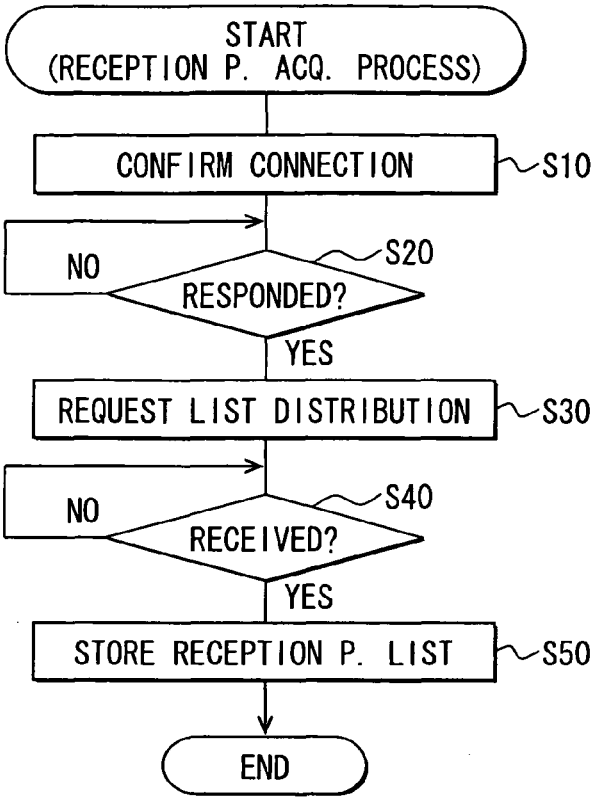
FIG. 2 is a flowchart illustrating a reception position acquisition process.

The following explains a procedure of a reception position acquisition process executed by the control circuit 27 of the navigation apparatus 2 using FIG. 2. FIG. 2 illustrates a flowchart of a reception position acquisition process. The reception position acquisition process is executed only once (one time) immediately after the control circuit 27 is turned into an on state or is powered on.

In S10, when the reception position acquisition process is started, the control circuit 27 executes a connection confirmation to the information center 3. That is, a connection confirmation signal for confirming whether to connect with the information center 3 is transmitted to the information center 3 via the wireless communication section 22.

In S20, the control circuit 27 or the processing stands by until receiving a connection response (i.e., a connection acknowledgement) from the information center 3. That is, it is determined whether to receive a connection response signal, which indicates that the information center 3 received the connection confirmation signal, from the information center 3 via the wireless communication section 22. When the connection response signal is not received (S20: NO), the processing stands by repeating the processing in S20.

In contrast, when the connection response signal is received (S20: YES), a distribution of a reception position list 32*a* is requested to the information center 3 in S30. That is, a distribution request signal, which requests a distribution of the reception position list 32*a*, is transmitted to the information center 3 via the wireless communication section 22.

In S40, the control circuit 27 or the processing stands by until receiving the distribution of the reception position list 32*a* from the information center 3. That is, it is determined whether the reception position list 32*a* is received from the information center 3 via the wireless communication section 22. When the reception position list 32*a* is not received (S40: NO), the processing stands by repeating the processing in S40. In contrast, when the reception position list 32*a* is received (S40: YES), the received reception position list 32*a* is stored in the data storage section 23 in S50, thereby ending the present reception position acquisition process.

Figure 3:
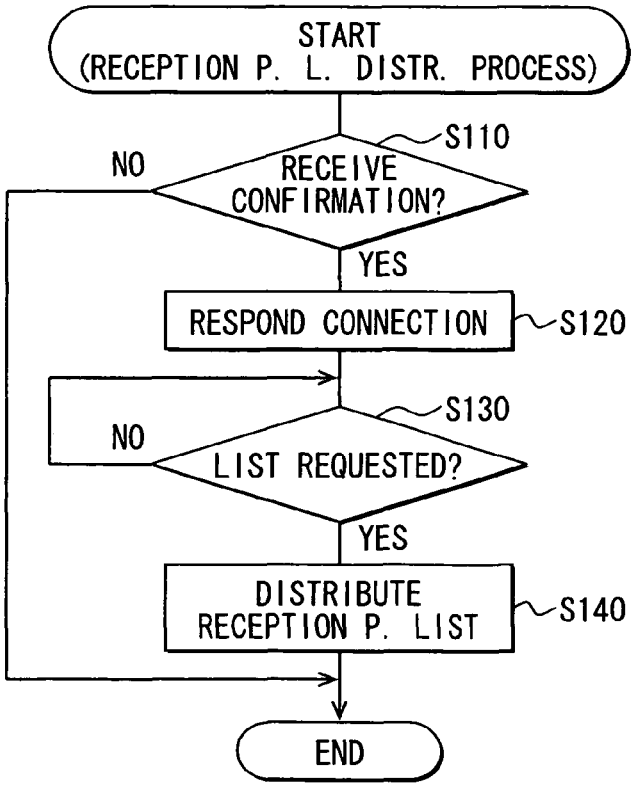
FIG. 3 is a flowchart illustrating a reception position list distribution process.

The following explains a procedure of a reception position list distribution process executed by the control circuit 33 of the information center 3 using FIG. 3. FIG. 3 illustrates a flowchart of the reception position list distribution process. The reception position list distribution process is repeatedly executed while the control circuit 33 is turned in an on state (i.e., powered on).

As the reception position list distribution process is started, the control circuit 33 determines whether a connection confirmation is received from the navigation apparatus 2 in S110. That is, it is determined whether the connection confirmation signal is received via the wireless communication section 31. When the connection confirmation signal is not received (S110: NO), the reception position list distribution process is once ended.

In contrast, when the connection confirmation signal is received (S110: YES), the connection response signal is transmitted to the navigation apparatus 2 via the wireless communication section 31 in S120. In S130, the control circuit 33 or the processing stands by until receiving a distribution request of the reception position list 32*a* from the navigation apparatus 2. That is, it is determined whether a distribution request signal is received via the wireless communication section 31. When a distribution request signal is not received (S130: NO), the processing stands by repeating the processing in S130.

In contrast, when a distribution request signal is received (S130: YES), the reception position list 32*a* is distributed in S140. That is, the reception position list 32*a* is transmitted to the navigation apparatus 2 via the wireless communication section 31. The present reception position list distribution process is then once ended.

Figure 4:
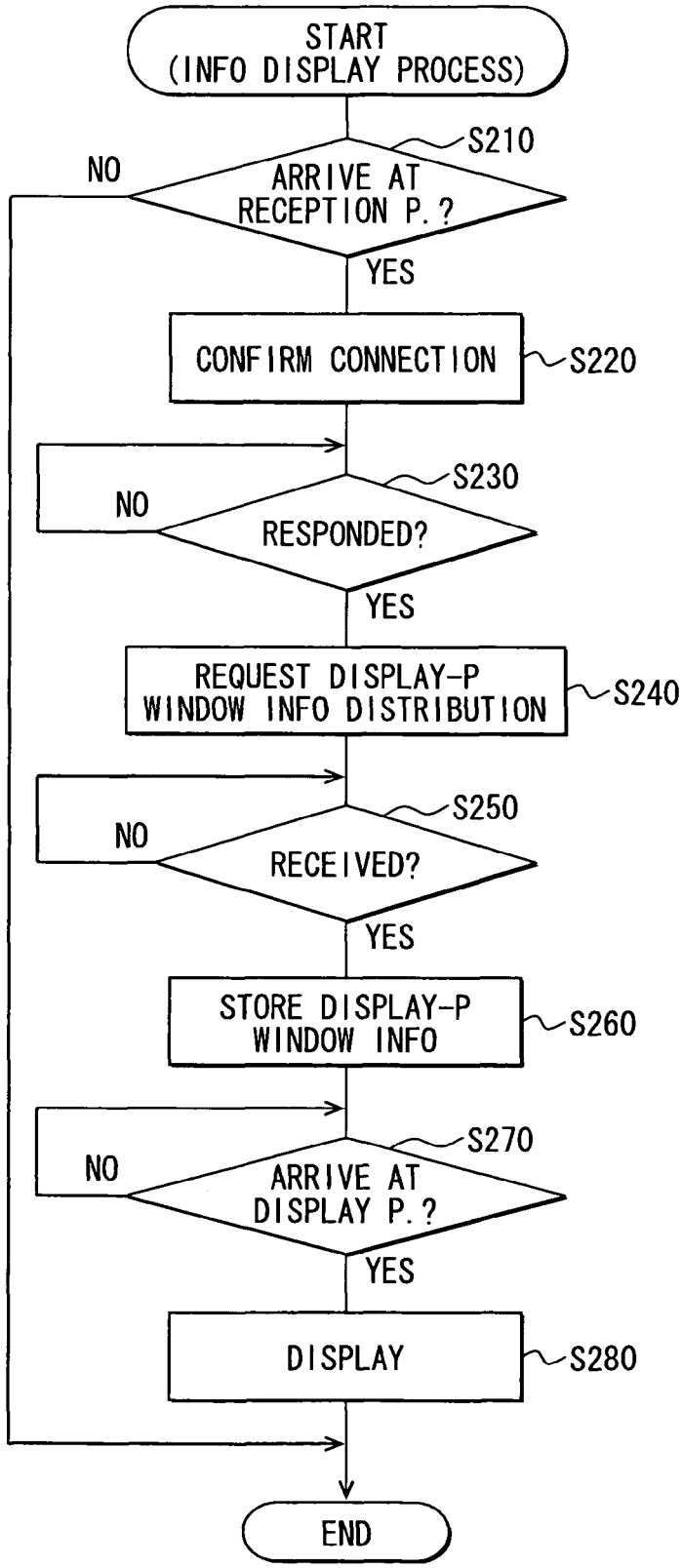
FIG. 4 is a flowchart illustrating an information display process according to a first embodiment of the present invention.

The following explains a procedure of an information display process executed by the control circuit 27 of the navigation apparatus 2 using FIG. 4. FIG. 4 illustrates a flowchart of an information display process. The information display process is repeatedly executed while the control circuit 27 is turned in an on state (powered on).

As the information display process is started, the control circuit 27 determines whether the subject vehicle reached or arrived at a reception position in S210. For example, while referring to the reception positions written in the reception position list 32*a* stored in the data storage section 23 in S50, a distance is calculated between the reception position and the present position of the subject vehicle detected using the position detection section 21. When the calculated distance is less than a predetermined reception position determination distance (e.g., 10 m), it is determined that the subject vehicle reached the reception position.

When the subject vehicle did not reach the reception position (S210: NO), the present information display process is once ended. When the subject vehicle reached the reception position (S210: YES), the connection confirmation is transmitted to the information center 3 in S220 like in S10. In S230, the control circuit 27 then stands by until receiving a connection response from the information center 3 like in S20.

When the connection response is received from the information center 3 (S230: YES), a distribution of the above-mentioned at-display-position window information and the display position information is requested to the information center 3 in S240. That is, reached reception position information for indicating a reception position, which is determined in S210 to be reached by the subject vehicle, and above-mentioned vehicle identification information are transmitted to the information center 3 via the wireless communication section 22.

The processing stands by until receiving a distribution of the at-display-position window information and the display position information from the information center 3 in S250. That is, it is determined whether an at-display-position window information item and a display position information item are received from the information center 3 via the wireless communication section 22. When the at-display-position window information and the display position information are not received (S250: NO), the processing stands by repeating the processing in S250. In contrast, when the at-display-position window information and the display position information are received (S250: YES), the received at-display-position window information and display position information are stored in the data storage section 23 in S260.

In S270, it is determined whether the subject vehicle reached or arrived at the display position. For instance, a distance is calculated between the display position stored in S260 and the present position of the subject vehicle detected using the position detection section 21. When the calculated distance is less than a predetermined display position determination distance (e.g., 10 m), it is determined that the subject vehicle reached the display position.

When the subject vehicle did not reach the display position (S270: NO), the processing stands by repeating the processing in S270. In contrast, when the subject vehicle reached the display position (S270: YES), the at-display-position window information item stored in S260 is displayed in the display section 25 in S280. The present information display process is then once ended.

Figure 5:
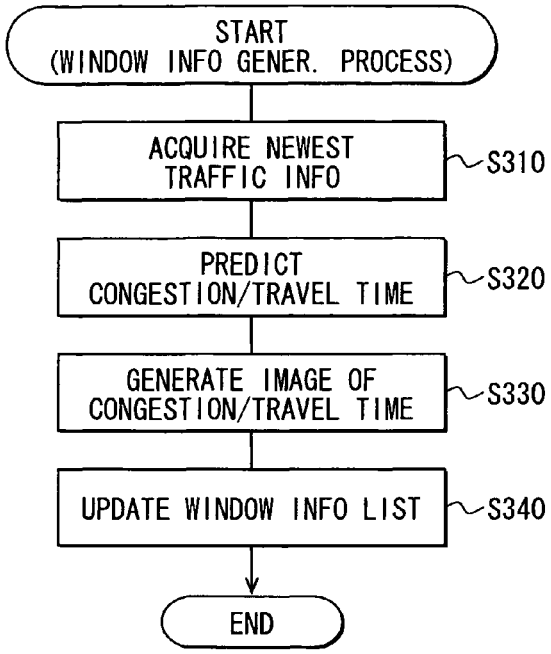
FIG. 5 is a flowchart illustrating a window information generation position acquisition process.

The following explains a procedure of a window information generation process executed by the control circuit 33 of the information center 3 using FIG. 5. FIG. 5 illustrates a flowchart of the window information generation process. The window information generation process is repeatedly executed while the control circuit 33 is turned in an on state (i.e., is powered on).

When the window information generation processing is started, the control circuit 33 acquires the newest traffic information from traffic information sources in S310. Furthermore, the source of the traffic information can be traffic information using a taxi probe, for example.

In S320, a traffic congestion state and a vehicle required travel time are predicted using statistic data on the acquired traffic information and the traffic information accumulated so far.

Furthermore, in S330, based on the result from the prediction in S320, an image illustrating a traffic congestion state or a vehicle required travel time is generated.

In S340, the control circuit 33 updates the traffic congestion image data and the required travel time image data corresponding to the image generated in S330, in the at-display-position window information stored in the window information list 32*b*, to the image data indicating the image generated in S330. The present window information generation process is then once ended.

Figure 6:
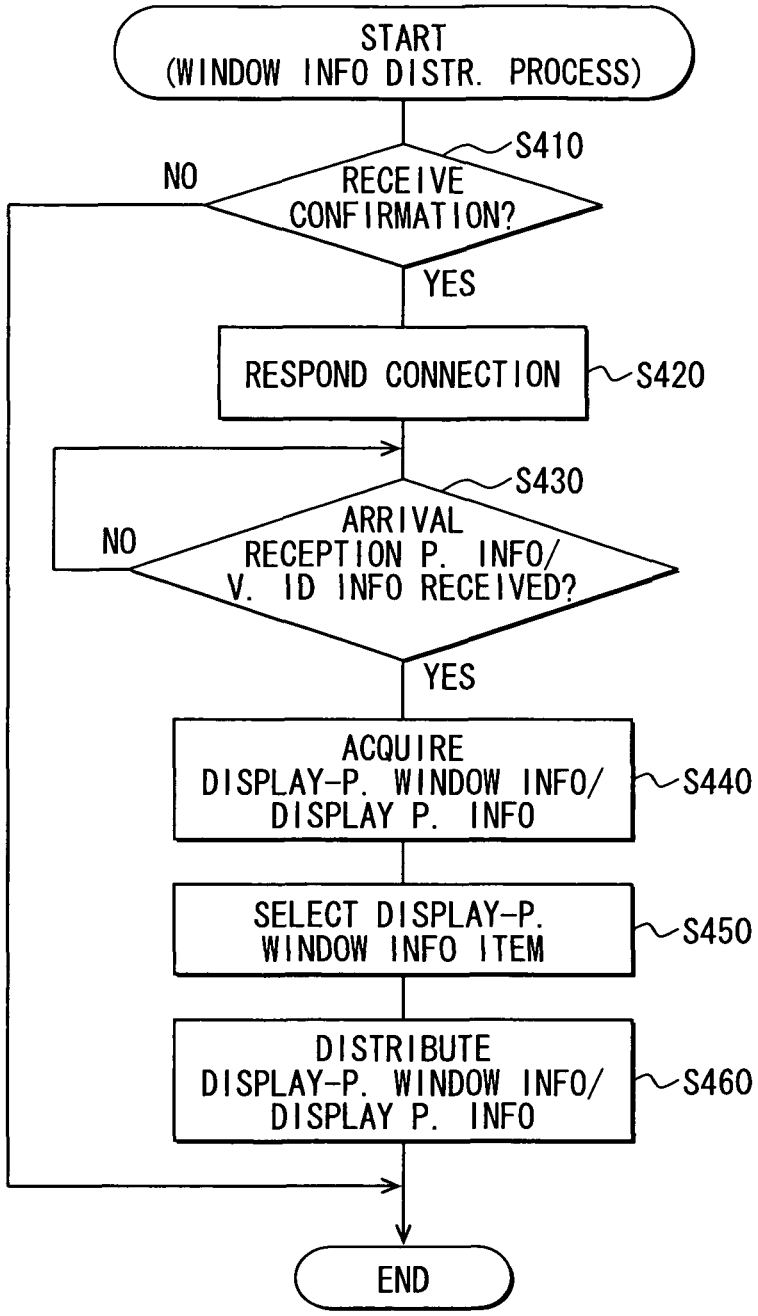
FIG. 6 is a flowchart illustrating a window information distribution process according to the first embodiment.

The following explains a procedure of a window information distribution process executed by the control circuit 33 of the information center 3 using FIG. 6. FIG. 6 illustrates a flowchart of the window information distribution process. The window information distribution process is repeatedly executed while the control circuit 33 is turned in an on state (or is powered on).

When the window information distribution process is started, the control circuit 33 determines whether a connection confirmation is received from the navigation apparatus 2 in S410 like in S110. That is, it is determined whether the connection confirmation signal is received via the wireless communication section 31. When the connection confirmation signal is not received (S410: NO), the present window information distribution process is then once ended.

In contrast, when a connection confirmation signal is received (S410: YES), the connection response signal is transmitted to the navigation apparatus 2 via the wireless communication section 31 in S420 like in S120. In S430, it is determined whether the above-mentioned reached reception position information and vehicle identification information are received from the navigation apparatus 2 via the wireless communication section 31. When the reached reception position information and vehicle identification information are not received (S430: NO), the processing stands by repeating the processing in S430.

In contrast, when the reached reception position information and vehicle identification information are received (S430: YES), display-related information (i.e., both of an at-display-position window information item and a display position information item) associated with or corresponding to the received reached reception position is acquired from the window information list 32*b* in S440.

In S450, while determining the vehicle type corresponding to the received vehicle identification information with reference to the vehicle type list 32*c*, based on the determined vehicle type, information which should be distributed is selected from within the at-display-position window information item acquired in S440. For example, the determined vehicle type may be a truck and a parking lot indicated by parking lot image data may not be used for trucks. In such a case, the information, which should be distributed, includes (i) enlarged view image data, (ii) required travel time image data, and (iii) traffic congestion image data, while excluding parking lot image data.

In S460, the at-display-position window information item and the display position information item are then distributed to the navigation apparatus 2. That is, the display position information item acquired in S440 and the at-display-position window information item selected in 450 are transmitted to the navigation apparatus 2 via the wireless communication section 31. The present window information distribution process is then once ended.

As explained in the above, the information provision system 1 includes (i) the navigation apparatus 2 mounted in the subject vehicle, and (ii) the information center 3 that provides an occupant of the vehicle with information. Herein, the navigation apparatus 2 and the information center 3 can communicate with each other using a wireless communication (i.e., via a wireless communication link). The data storage section 32 of the information center 3 stores reception position information indicating several reception positions at each of which the navigation apparatus 2 is allowed to wirelessly communicate with the information center 3; further, the data storage section 32 stores, with respect to each reception position, (i) a reception position information item indicating the each of reception position, (ii) a display position information item, and (iii) an at-display-position window information item, in association with each other. In addition, the position detection section 21 of the navigation apparatus 2 detects a present position of the subject vehicle.

The information center 3 distributes the reception position information or information item, which indicates the several reception positions and stored in the data storage section 32, to the navigation apparatus 2 via the wireless communication link (S140). In contrast, the navigation apparatus 2 acquires the reception position information or information item which the information center 3 distributed via the wireless communication link (S40, S50).

Then, the navigation apparatus 2 determines whether the vehicle reaches a reception position based on the reception positions indicated by the acquired reception position information, and the present position which the position detection section 21 detects (S210).

When it is determined that the vehicle'reaches a reception position (S210: YES), the reached reception position information which indicates the reached reception position is transmitted to the information center 3 via the wireless communication link (S240). The information center 3 thereby acquires the reached reception position information from the navigation apparatus 2 via the wireless communication link (S430).

Furthermore, the information center 3 distributes via the wireless communication link to the navigation apparatus 2, as display-related information, (i) a display position information item and (ii) an at-display-position window information item, both of which correspond to the acquired reached reception position information from among the several at-display-position window information items and display position information items, both of which the data storage section 32 stores (S440 to S460). The navigation apparatus 2 then acquires the display position information or information item and the at-display-position window information or information item from the information center 3 via the wireless communication link (S250, S260).

Then, the navigation apparatus 2 determines whether the vehicle arrives at a display position based on the display position indicated by the acquired display position information item, and the present position which the position detection section 21 detects (S270). Thereafter, when it is determined that the vehicle reaches the display position (S270:

YES), the display window contents indicated by the acquired at-display-position window information item are displayed (S280).

According to the information provision system 1, the navigation apparatus 2 can acquire the reception position information item, which indicates several reception positions, from the information center 3, and, further, communicates via the wireless communication link with the information center 3 at one of the reception positions indicated by the required reception position information item to thereby acquire the at-display-position window information. Therefore, when changing or increasing the reception positions, only the reception position information item stored in the information center 3 is required to be changed or increased. Accordingly, as compared with the case where beacons and over-road devices are installed, the position (reception position) at which the navigation apparatus 2 acquires the at-display-position window information can be easily changed or increased.

In addition, the at-display-position window information displayed by the navigation apparatus 2 is distributed from the information center 3. Therefore, it is not necessary to store at-display-position window information previously in the navigation apparatus 2. When the display window contents of the at-display-position window information is changed, changing the display window contents of the at-display-position window information stored in the information center 3 is only necessary. That is, whenever the display window contents of the at-display-position window information are changed, it is not necessary to update the at-display-position window information in the navigation apparatus 2. Accordingly, the information center 3 appropriately updates the at-display-position window information; thereby, the navigation apparatus 2 is not specially required to do update work. The newest at-display-position window information can be easily acquired.

In addition, when transmitting the reached reception position information to the information center 3, the navigation apparatus 2 also transmits the vehicle identification information to the information center 3 via the wireless communication link (S240). The information center 3 thereby acquires the vehicle identification information from the navigation apparatus 2 via the wireless communication link (S430). The information center 3 determines a part of the at-display-position window information item (referred to as an at-display-position window information sub-item), which should be distributed, based on the acquired vehicle identification information, from among the at-display-position window information item stored in the data storage section 32 (S450).

According to the information provision system 1 of the present embodiment, the information center 3 can distribute the at-display-position window information suitable for the vehicle equipped with the navigation apparatus 2 based on the vehicle identification information.

In the embodiment described above, the data storage section 32 may function as a storage means or section to store communication position information (or a communication position) or a notification-related information. The processing in S140 by the control circuit 33 may function as a distribution means or section to distribute a communication position. The processing in S430 by the control circuit 33 may function as an acquisition means or section to acquire a reached communication position or a vehicle identification. The processing in S440 to S460 by the control circuit 33 may function as a distribution means or section to distribute a notification or notification information.

In addition, the reception position may be referred to as a communication position. The reception position information may be referred to as communication position information. The at-display-position window information may be referred to as notification information. The display position information may be referred to as notification position information (or at-notification-position information). The at-display-position window information and the display position information may be collectively referred to as display-related information or may be genetically referred to as notification-related information. The present position which the position detection section 21 detects may be referred to as vehicle position information.

In addition, the navigation apparatus 2 may function as an in-vehicle apparatus. The position detection section 21 may function as a vehicle position acquisition means or section to acquire a position of the vehicle. The processing in S40 and S50 by the control circuit 27 may function as a communication position acquisition means or section. The processing in S210 by the control circuit 27 may function as a communication position determination means or section. The processing in S240 by the control circuit 27 may function as a transmission means or section to transmit a reached communication position or a vehicle identification. The processing in S210 by the control circuit 27 is a notification acquisition means or section. The processing in S270 by the control circuit 27 is a notification position determination means or section. The processing in S280 by the control circuit 27 is a notification means or section.

Second Embodiment

The following describes a second embodiment of the present invention. Furthermore, the following explains the second embodiment with respect to only part different from the first embodiment.

The information provision system 1 of the second embodiment has the same configuration as that of the first embodiment except that the information display process and the window information distribution process are changed.

Figure 8:
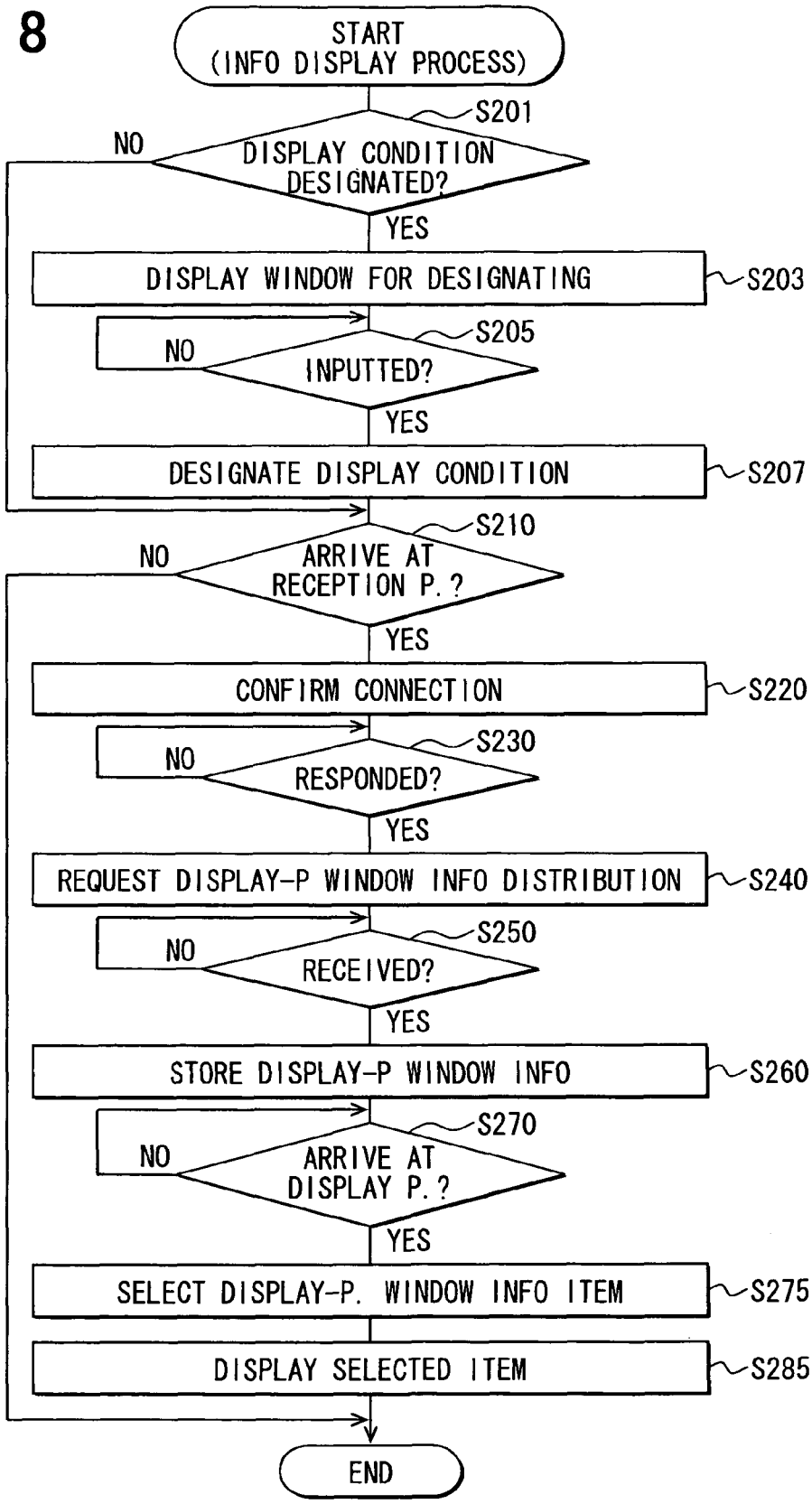
FIG. 8 is a flowchart illustrating an information display process according to a second embodiment of the present invention.

First, the following explains a procedure of an information display process of the second embodiment using FIG. 8. FIG. 8 illustrates a flowchart of the information display process according to the second embodiment.

The information display process of the second embodiment is the same as that of the first embodiment except that processing in S280 is omitted and processing in S201-S207, S275, and S285 is added.

That is, when the information display process is started, the control circuit 27 of the navigation apparatus 2 determines in S201 whether a display condition designation operation is made via the operation switch group 24. The display condition designation operation is for designating a display condition when displaying the at-display-position window information distributed from the information center 3. When the display condition designation operation is not made (S201: NO), the processing advances to S210.

When the display condition designation operation is made (S201: YES), the display section 25 is caused to display a condition designation window for designating or setting up a display condition in S203. The display condition designation window is configured to enable one display condition to be designated from five display conditions as follows.

The first display condition is for displaying unconditionally a whole of the at-display-position window information (or information item) distributed from the information center 3.

The second display condition is for displaying, from within the at-display-position window information distributed from the information center 3, a portion which is required when the vehicle may undergo an inconvenience ahead of the traveling direction along a guidance route. For example, when the traffic congestion occurs on a guidance route, traffic congestion image data included in the at-display-position window information is displayed. When a traffic congestion does not occur on the guidance route, traffic congestion, image data is not displayed.

The third display condition is for displaying information indicating an unusual state from among the at-display-position window information distributed from the information center 3. For example, a traffic congestion may occur, near a display position, on a road which usually does not undergo a traffic congestion. In such a case, information indicating the traffic congestion is displayed.

In addition, the fourth display condition is for not displaying the information relevant to traffics from among the at-display-position window information distributed from the information center 3, when the navigation apparatus 2 executes a route guidance.

The fifth display condition is for displaying none of the at-display-position window information distributed from the information center 3.

In S205, it is determined whether the display condition designation information for designating a single display condition from the above-mentioned five display conditions is inputted via the operation switch group 24. When the display condition designation information is not inputted (S205: NO), the processing stands by repeating the processing in S205. When the display condition designation information is inputted (S205: YES), a display condition indicated by the inputted display condition designation information is designated in S207. The processing then advances to S210.

Further, when the subject vehicle arrives at a display position (S270: YES), the information which should be displayed is selected in S275 from the at-display-position window information distributed from the information center 3 based on the display condition designated in S207.

Figure 10A:
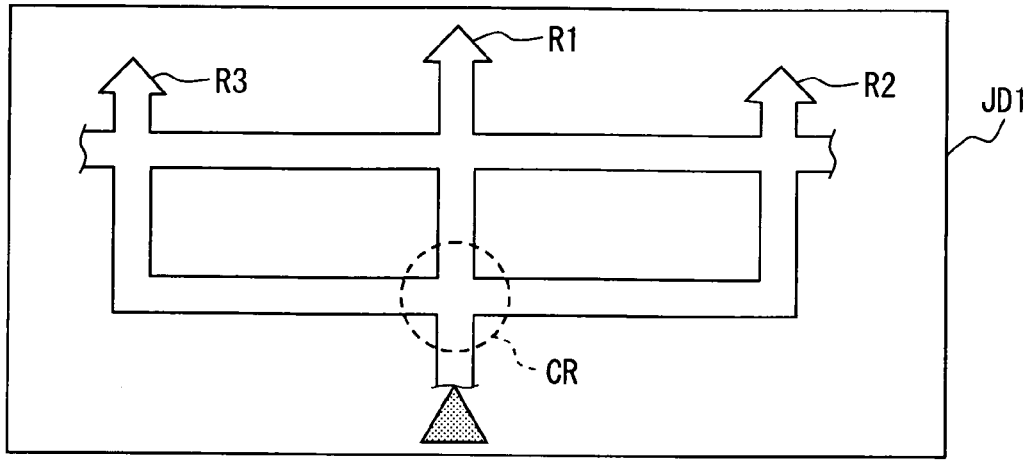
FIGS. 10A to 10C is diagrams illustrating traffic congestion image data.
Figure 10B:
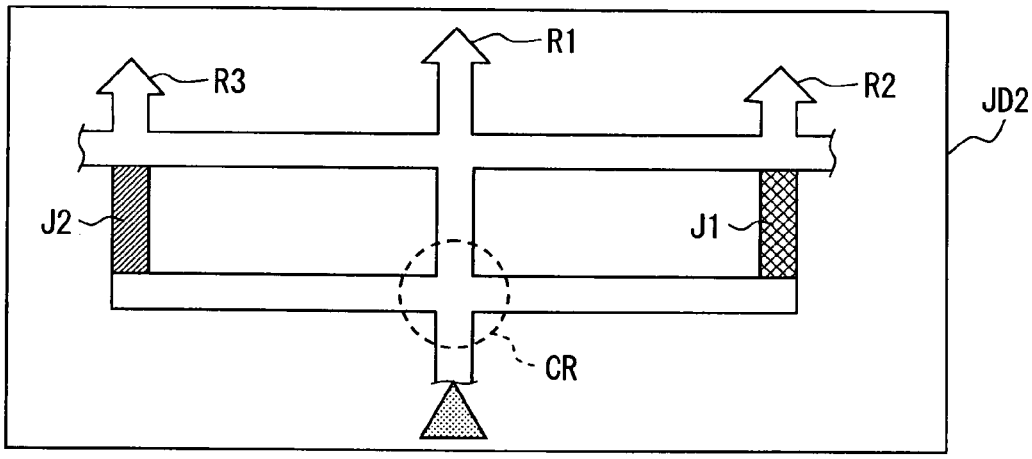
Figure 10C:
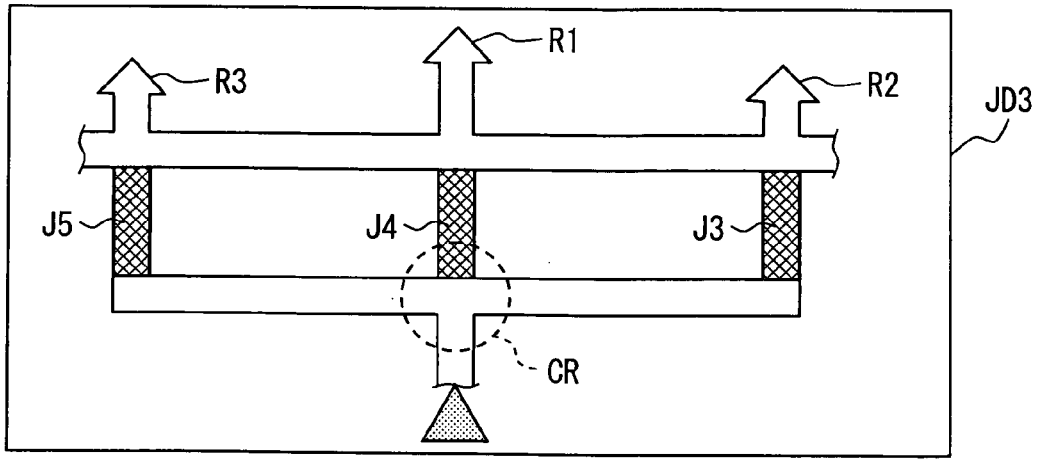

The following explains a selection, for example, in case the display condition designated in S207 is the second display condition, using FIGS. 10A to 10C. FIGS. 10A to 10C illustrate examples of traffic congestion image data respectively distributed from the information center 3. In FIGS. 10A to 10C, when traveling straight at an intersection CR, a subject vehicle (triangle) enters a road R1. When turning to the right, it enters a road R2. When turning to the left, it enters a road R3.

The traffic congestion image data JD1 of FIG. 10A illustrates that roads R1, R2, and R3 are not in a congested state, but in a favorable state. The traffic congestion image data JD2 of FIG. 10B illustrates that the road R1 is in a favorable state, the road R2 is in a congested state (see section J1), and the road R3 is in a congested state (see section J2). The traffic congestion image data JD3 of FIG. 10C illustrates that the roads R1, R2, R3 are all in a congested state (see sections J3, J4, J5).

The second display condition is for displaying, among the at-display-position window information distributed from the information center 3, a portion which is required when the vehicle may undergo an inconvenience ahead of the traveling direction along the guidance route. Under the second display condition, when the vehicle's traveling along a guidance route causes an inconvenience or problem on the vehicle's traveling, the at-display-position window information is displayed. Accordingly, when the traffic congestion image data JD1 is distributed from the information center 3, the traffic congestion image data JD1 is not selected in S275.

Further, when the traffic congestion image data JD2 is distributed from the information center 3 and the road R1 is included in the guidance route, the traffic congestion image data JD2 is not selected in S275. In contrast, when the guidance route includes the road R2 or R3, the traffic congestion image data JD2 is selected.

Further, when the traffic congestion image data JD3 is distributed from the information center 3, the traffic congestion image data JD3 is selected in S275.

When the processing in S275 is completed, the at-display-position window information selected in S275 is displayed in the display section 25 in S285. The present information display process is once ended.

Figure 9:
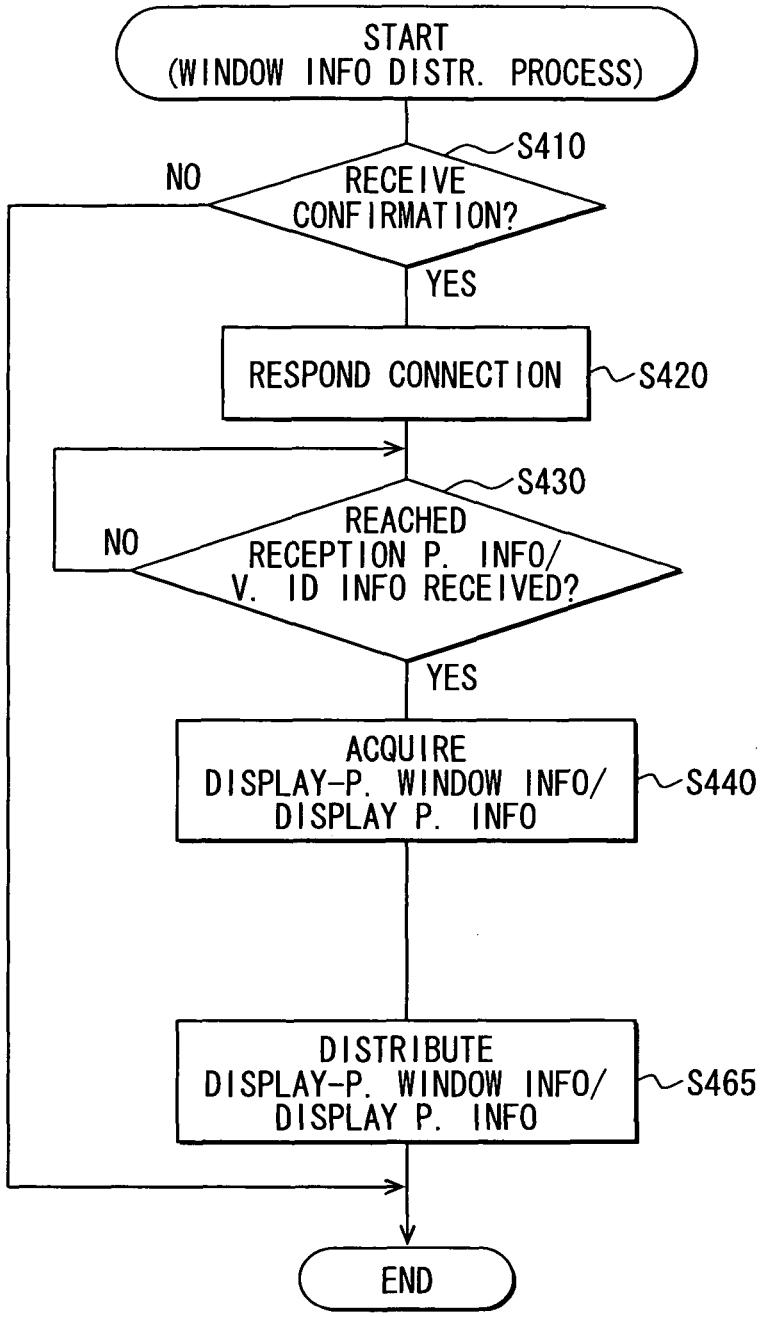
FIG. 9 is a flowchart illustrating a window information distribution process according to the second embodiment.

The following explains a procedure of a window information distribution process of the second embodiment using FIG. 9. FIG. 9 illustrates a flowchart of a window information distribution process according to the second embodiment.

The window information distribution process of the second embodiment is the same as that of the first embodiment except that processing in S450, S460 is omitted and processing in S465 is added.

That is, when the processing in S440 is ended, the at-display-position window information and display position information which were acquired in S440 are transmitted to the navigation apparatus 2 via the wireless communication section 31 in S465. The present window information distribution process is then once ended.

In the information provision system 1 of the present embodiment, the navigation apparatus 2 determines the information, which should be displayed, from the acquired at-display-position window information based on the display condition designated previously (S275). Thereby, based on the display condition, the at-display-position window information suitable for the vehicle equipped with the navigation apparatus 2 can be determined and displayed by the navigation apparatus 2 instead of the information center 3.

In addition, the display condition is designated based on the external operation set up previously (S201-S207). Thereby, the conditions (display condition) for determining a part of the at-display-position window information which should be displayed can be set up, based on the intention of the occupant of the vehicle equipped with the navigation apparatus 2, from the acquired at-display-position window information.

In the present embodiment described above, the processing in S201 to S207 by the control circuit 27 of the navigation apparatus 2 may function as a condition designation means or section. The display condition may be referred to as a notification determination means or section.

(Modification)

Although the embodiments are described above, the present invention is not limited to the above embodiments and can be modified in various manners.

For example, the distributed information in the above embodiments includes road traffic information such as an enlarged view image, a required travel time image, a traffic congestion image, and a parking lot image. Information on nearby facilities or commercial information may be further distributed.

In addition, in the above embodiments, the information distributed from the information center 3 is displayed (information is outputted via a display). In contrast, the information distributed from the information center 3 may be outputted via the audio output section 26.

In addition, in the above embodiments, the reception position acquisition process is executed one time immediately after the control circuit 27 is turned into an on state (i.e., powered on). Without need limited to the above, another may be adopted. When an execution condition designated previously is satisfied, the reception position acquisition process may be optionally executed. For example, the next reception position acquisition process can be executed each time a predetermined execution time elapses after executing the previous reception position acquisition process.

In addition, although the reception position information and display position information are represented using link information, they can be also represented using latitudes and longitudes.

In addition, in the above embodiments, the navigation apparatus 2 determines whether the distributed traffic congestion image data is displayed or not based on the display condition set up previously. In this regard, however, the following can be differently designed: the information center 3 predicts the heading direction of the subject vehicle, and determines whether to distribute the traffic congestion image data based on the predicted result. For example, assume the case, as illustrated in FIG. 10A, when traveling straight at the intersection CR, the road R1 is entered; when turning to the right, the road R2 is entered; and when turning to the left, the road R3 is entered. In such a case, the information center 3 can determine whether to distribute the traffic congestion image data on the premise of the vehicle going straight on to thereby entering or running the road R1. That is, in the case of the traffic congestion image data JD1 in FIG. 10A, or the traffic congestion image data JD2 in FIG. 10B, since there is no congestion on the road R1 which is a travel road when the vehicle goes straight on, the information center 3 does not distribute the traffic congestion image data JD1 and traffic congestion image data JD2. In contrast, in the case of the traffic congestion image data JD3 in FIG. 10C, since there is a congestion on the road R1 which is a travel road when the vehicle goes straight on, the information center 3 distributes the traffic congestion image data JD3.

In addition, although the type of the vehicle is specified based on the vehicle identification information in the above embodiments, another information may be specified based on the vehicle identification information. For example, based on the vehicle identification information, an individual or a group may be specified. Otherwise, the vehicle traveling for the same purpose may be specified; then, based on the specified result, the information to be distributed may be selected based on the specified result.

In addition, in the above embodiments, the navigation apparatus 2 acquires the at-display-position window information or information item relative to a single display position at a single reception position. Otherwise, at a single reception position, the at-display-position window information or information item relative to several display positions may be acquired.

In addition, in the information provision system 1, information may not be distributed to a specific area. To achieve such a configuration, the above specific area may be excluded from the reception positions indicated by the reception position information in the reception position list 32*a*. Otherwise, the following can be designed; namely, when the distribution request may occur from the navigation apparatus 2, which is located in the above mentioned specific area, the information center 3 does not distribute any information.

Further, in the information provision system 1 of the above embodiments, when important regulation information like a traffic stop is acquired, irrespective of the presence or absence of a distribution request from the navigation apparatus 2, the information center 3 can be designed to distribute such regulation information to the navigation apparatus 2.

Further, in the information provision system 1 of the above embodiments, a distribution term of validity may be provided in the at-display-position window information which the information center 3 distributes. After the distribution term of validity elapses or expires, it can be designed that the relevant at-display-position window information is not distributed.

Each or any combination of processes, steps, or means explained in the above can be achieved as a software section or unit (e.g., subroutine) and/or a hardware section or unit (e.g., circuit or integrated circuit), including or not including a function of a related device; furthermore, the hardware section or unit can be constructed inside of a microcomputer. Furthermore, the software section or unit or any combinations of multiple software sections or units can be included in a software program, which can be contained in a computer-readable storage media or can be downloaded and installed in a computer via a communications network.

Aspects of the disclosure described herein are set out in the following clauses.

As a first aspect of the disclosure, an information provision system is provided to include an in-vehicle apparatus in a vehicle and an information center for providing an occupant of the vehicle with information. Herein, the in-vehicle apparatus and the information center are communicable with each other using a wireless communication. The information center comprises the following: a communication position storage section; a notification storage section; a communication position distribution section; a reached communication position acquisition section; and a notification distribution section. The communication position storage section is configured to store a communication position information item to indicate several communication positions at which the in-vehicle apparatus is allowed to execute the wireless communication with the information center. The notification storage section is configured to store, with respect to each of the communication positions, (i) a communication position information item for indicating the each of the communication positions, (ii) a notification position information item for indicating a notification position, and (iii) a notification information item which is notified to the occupant of the vehicle at the notification position, in association with each other. The communication position distribution section is configured to distribute to the in-vehicle apparatus the communication position information item, which indicates the several communication positions and is stored in the communication position storage section, using the wireless communication. The reached communication position acquisition section is configured to acquire a reached communication position information item indicating a reached communication position, which is one of the several communication positions and reached by the vehicle, from the in-vehicle apparatus using the wireless communication. The notification distribution section is configured to distribute, with respect to the acquired reached communication position information item, a notification position information item and a notification information item from within the notification position information items and the notification information items stored in the notification storage section, to the in-vehicle apparatus using the wireless communication. In contrast, the in-vehicle apparatus comprises the following: a vehicle position acquisition section; a communication position acquisition section; a communication position determination section; a reached communication position transmission section; a notification acquisition section; a notification position determination section; and a notification section. The vehicle position acquisition section is configured to acquire a vehicle position information item indicating a present position of the vehicle. The communication position acquisition section is configured to acquire the communication position information item, which is distributed by the communication position distribution section of the information center using the wireless communication. The communication position determination section is configured to determine whether the vehicle reaches a communication position, based on (i) the communication positions indicated by the acquired communication position information item, and (ii) a present position of the vehicle indicated by the acquired vehicle position information item. The reached communication position transmission section is configured to transmit the reached communication position information item indicating the reached communication position being the one of the several communication positions, when the communication position determination section determines that the vehicle reaches the one of the several communication positions, to the information center using the wireless communication. The notification acquisition section is configured to acquire the notification position information item and the notification information item, both of which are distributed by the notification distribution section of the information center using the wireless communication. The notification position determination section is configured to determine whether the vehicle reaches the notification position, based on (i) the notification position indicated by the acquired notification position information item (ii) the present position of the vehicle indicated by the acquired vehicle position information item. The notification section configured to notify the occupant of the vehicle of contents indicated by the acquired notification information item when the notification position determination section determines that the vehicle reaches the notification position.

Under the above aspect, the in-vehicle apparatus acquires information on several communication positions (i.e., reception positions) from the information center and executes the wireless communication at one of the reception positions to thereby acquire notification information from the information center. Therefore, when changing or increasing the reception positions, only the communication position information (i.e., reception position information) stored in the information center is required to be changed or increased. Accordingly, as compared with the case where beacons and over-road devices are installed, the communication position (i.e., reception position) at which the navigation apparatus acquires the notification information (i.e., at-display-position window information) can be easily changed or increased.

In addition, the notification information notified in the in-vehicle apparatus is distributed from the information center. Therefore, it is not necessary for the in-vehicle apparatus to store such notification information previously. When changing the contents of notification information, only the notification information stored in the information center needs to be changed. That is, there is no need for the in-vehicle apparatus to update the notification information each time the contents of the notification information are changed. Accordingly, by updating the notification information as needed in the information center, without need of update work in the in-vehicle apparatus, the newest notification information (i.e., at-display-position window information) can be easily acquired by the in-vehicle apparatus.

As an optional aspect of the above information provision system, the in-vehicle apparatus may further comprise a vehicle identification transmission section to transmit a vehicle identification information item for identifying the vehicle to the information center using the wireless communication, when the reached communication position transmission section transmits the reached communication position information item. In contrast, the information center may further comprise a vehicle identification acquisition section to acquire the vehicle identification information item transmitted by the vehicle identification transmission section of the in-vehicle apparatus using the wireless communication. Herein, the notification distribution section may be further configured to determine the notification information item, which is to be distributed, from within the notification information items stored in the notification storage section based on the vehicle identification information item acquired by the vehicle identification acquisition section.

For instance, the information center may stores, with respect to each of the vehicle identifications (IDs), (i) a vehicle identification information item and (ii) a vehicle type (passenger car, truck, bus, etc.) assigned with the vehicle identification information item, in association with each other. Based on the acquired vehicle identification information, the vehicle type can be specified. For instance, when information illustrating a position of a parking lot around the communication position is distributed from the information center as notification information, only the information on the parking lot only used for the vehicle of the specified vehicle type may be distributed.

As an optional aspect of the information provision system, the notification section of the in-vehicle apparatus may be further configured to determine a notification information sub-item which is to be notified based on a predetermined notification determination condition from within the acquired notification information item indicating several notification sub-items.

Under the above optional aspect, based on the notification determination condition, the notification information suitable for the vehicle equipped with the in-vehicle apparatus can be determined in the in-vehicle apparatus, instead of the information center, and notified.

As a further optional aspect, the in-vehicle apparatus may further comprise a condition designation section to designate the notification determination condition based on a predetermined external operation.

Under the above optional aspect, the occupant or user of the vehicle can designate the notification determination condition to determine the notification information which should be notified the occupant from within the notification information acquired.

As a second aspect of the disclosure, an in-vehicle apparatus is provided as being the in-vehicle apparatus included in the above information provision system of the first aspect of the disclosure.

Further, as a third aspect of the disclosure, a method used in the above information provision system according to the first aspect is provided.

It will be obvious to those skilled in the art that various changes may be made in the above-described embodiments of the present invention. However, the scope of the present invention should be determined by the following claims.

What is claimed:

1. An information provision system for providing an occupant of the vehicle with information, comprising:

an information center including at least an information center controller, an information center data storage, and an information center wireless communication mechanism; and an in-vehicle apparatus including at least an in-vehicle apparatus controller, an in-vehicle apparatus data storage, and an in-vehicle wireless communication mechanism, an in-vehicle apparatus wireless communication mechanism, a vehicle position detector, and an output mechanism, the in-vehicle apparatus and the information center operable to communicate with each other by a wireless communication between the in-vehicle wireless apparatus communication mechanism and the information center wireless communication mechanism, wherein:

the information center data storage stores a communication position information item to indicate a plurality of communication positions at which the in-vehicle apparatus is allowed to execute the wireless communication between the in-vehicle apparatus and the information center;

the information center data storage stores, with respect to each of the plurality of communication positions, (i) a communication position information item for indicating the each of the communication positions, (ii) a notification position information item for indicating a notification position, and (iii) a notification information item which is notified to the occupant of the vehicle at the notification position, in association with each other;

the information center controller causes the information center wireless mechanism to distribute to the in-vehicle apparatus, by the wireless communication, the communication position information item, which indicates the plurality of communication positions;

the information center wireless communication mechanism acquires a reached communication position information item indicating a reached communication position, which is a communication position, from among the plurality of communication positions, that is reached by the vehicle, from the in-vehicle apparatus wireless mechanism using the wireless communication;

the information center controller, with respect to the acquired reached communication position information item, causes the information center wireless mechanism to distribute a notification position information item and a notification information item from among the notification position information items and the notification information items stored in the information center data storage, to the in-vehicle apparatus using the wireless communication;

the vehicle position detector acquires a vehicle position information item indicating a present position of the vehicle;

the in-vehicle apparatus wireless communication mechanism acquires the communication position information item, which is distributed by the information center wireless mechanism using the wireless communication;

the in-vehicle apparatus controller determines whether the vehicle reaches a communication position, based on (i) the communication positions indicated by the acquired communication position information item, and (ii) a present position of the vehicle indicated by the acquired vehicle position information item;

the in-vehicle apparatus controller causes the in-vehicle apparatus wireless mechanism to transmit the reached communication position information item indicating the reached communication, when the in-vehicle apparatus controller determines that the vehicle reaches the one of the several communication positions, to the information center using the wireless communication;

the in-vehicle apparatus wireless communication mechanism acquires the notification position information item and the notification information item, both of which are distributed by the information center wireless communication mechanism using the wireless communication;

the in-vehicle apparatus controller determines whether the vehicle reaches the notification position, based on (i) the notification position indicated by the acquired notification position information item (ii) the present position of the vehicle indicated by the acquired vehicle position information item; and the in-vehicle apparatus controller causes the output mechanism to notify the occupant of the vehicle of contents indicated by the acquired notification information item when the in-vehicle apparatus controller determines that the vehicle reaches the notification position.

2. The information provision system according to claim 1, wherein:

the in-vehicle apparatus controller causes the in-vehicle apparatus wireless mechanism to transmit a vehicle identification information item for identifying the vehicle to the information center using the wireless communication, when the in-vehicle apparatus controller causes the in-vehicle apparatus wireless mechanism to transmit the reached communication position information item, the information center wireless mechanism acquires the vehicle identification information item transmitted by the in-vehicle apparatus wireless mechanism using the wireless communication, and the information center controller determines the notification information item to be distributed from the information center data storage based on the vehicle identification information item acquired by the information center wireless mechanism.

3. The information provision system according to claim 1, wherein the in-vehicle apparatus controller determines a notification information sub-item which is to be output by the output mechanism based on a predetermined notification determination condition from within the acquired notification information item indicating several notification sub-items.

4. The information provision system according to claim 3, wherein the in-vehicle apparatus controller further designates the notification determination condition based on a predetermined external operation.

5. An in-vehicle apparatus in a vehicle, operable to communicate with an information center using a wireless communication, for providing an occupant of the vehicle with information, the in-vehicle apparatus comprising:

a storage;

a controller;

a vehicle position detector;

an output mechanism; and a wireless communication mechanism, the vehicle position detector acquiring a vehicle position information item indicating a present position of the vehicle;

the wireless communication mechanism, using the wireless communication, communication position information item, which indicates several communication positions at which the wireless communication is allowed to be executed with the information center;

the controller determining whether the vehicle reaches a communication position being one of the communication positions indicated by the acquired communication position information item, based on (i) the communication positions indicated by the communication position information item acquired by the wireless communication mechanism, and (ii) the present position of the vehicle indicated by the vehicle position information item acquired by the vehicle position detector;

the controller causing the wireless communication mechanism to transmit to the information center using the wireless communication, a reached communication position information item indicating a reached communication position, which is one of the several communication positions, when the controller determines that the vehicle reaches the one of the several communication positions;

the wireless communication mechanism acquiring from the information center, using the wireless communication, a notification position information item and a notification information item associated with the reached communication position indicated by the reached communication position information item transmitted by wireless communication mechanism, the notification position information item indicating a notification position at which the in-vehicle apparatus is allowed to notify the occupant of the vehicle;

the controller determining, based on (i) the notification position indicated by the notification position information item acquired by wireless communication mechanism, and (ii) the present position of the vehicle indicated by the vehicle position information item acquired by the vehicle position detector, whether the vehicle reaches the notification position; and the controller causing the output mechanism to notify the occupant of the vehicle of contents indicated by the notification information item acquired by the wireless communication mechanism when controller determines that the vehicle reaches the notification position.

6. The in-vehicle apparatus according to claim 5, the controller further determining a notification information sub-item which is to be output by the output mechanism based on a predetermined notification determination condition from within the acquired notification information item indicating several notification sub-items.

7. The in-vehicle apparatus according to claim 6, controller further designating the notification determination condition based on a predetermined external operation.

8. A method for providing an occupant of a vehicle with information in a system including an information center and an in-vehicle apparatus in the vehicle, the information center and the in-vehicle apparatus communicable with each other using a wireless communication, the information center storing information on several communication positions at which the in-vehicle apparatus is allowed to execute the wireless communication with the information center, and notification-related information, which associates, with respect to each of the communication positions, (i) a notification position, and (ii) notification contents notified at the notification position, the in-vehicle apparatus acquiring a present position of the vehicle, the method comprising:

transmitting from the information center to the in-vehicle apparatus the stored information on several communication positions;

determining in the in-vehicle apparatus that the vehicle reaches a communication position being one of the several communication positions, based on an acquired present position;

transmitting from the in-vehicle apparatus to the information center, information indicating the reached communication position;

transmitting from the information center to the in-vehicle apparatus, notification-related information, which is selected from the stored notification-related information, the selected notification-related information containing a notification position and notification contents in association with the reached communication position; and determining by the in-vehicle apparatus that the vehicle reaches the notification position indicated by the received notification-related information, based on an acquired vehicle position, thereby notifying the occupant of the vehicle of the notification contents indicated by the received notification-related information at the reached notification position.

* * * * *